US008926712B2

(12) United States Patent
Jiang et al.

(10) Patent No.: US 8,926,712 B2
(45) Date of Patent: Jan. 6, 2015

(54) SOLVENT SPUN BAMBOO FIBER WITH HIGH WET MODULUS AND PRODUCING METHOD THEREOF

(75) Inventors: Kun Jiang, Shanghai (CN); Xiaoliang Wang, Shanghai (CN); Changli Zhu, Shanghai (CN); Xin Wang, Shanghai (CN); Dianhai Zheng, Shanghai (CN)

(73) Assignee: Shanghai Lyocell Fibre Development Co., Ltd., Shanghai (CN)

( * ) Notice: Subject to any disclaimer, the term of this patent is extended or adjusted under 35 U.S.C. 154(b) by 111 days.

(21) Appl. No.: 13/499,512

(22) PCT Filed: Sep. 7, 2010

(86) PCT No.: PCT/CN2010/001359

§ 371 (c)(1),
(2), (4) Date: Jun. 8, 2012

(87) PCT Pub. No.: WO2011/038568

PCT Pub. Date: Apr. 7, 2011

(65) Prior Publication Data

US 2012/0241669 A1 Sep. 27, 2012

(30) Foreign Application Priority Data

Sep. 30, 2009 (CN) ..... 2009 1 0196861

(51) Int. Cl.

| | |
|---|---|
| ***D01F 4/00*** | (2006.01) |
| ***D01F 2/04*** | (2006.01) |
| ***D21C 3/04*** | (2006.01) |
| ***D01C 1/00*** | (2006.01) |
| ***D01F 2/00*** | (2006.01) |
| ***D01D 5/04*** | (2006.01) |

(52) U.S. Cl.

CPC .. *D01C 1/00* (2013.01); *D01F 2/00* (2013.01); *D01D 5/04* (2013.01)

USPC ..... 8/116.1; 264/103; 264/147; 264/189; 264/194; 264/199; 264/129; 264/143; 264/203; 264/233; 162/70; 162/76

(58) Field of Classification Search

USPC ..... 162/70, 76; 264/103, 129, 147, 187, 264/189, 194, 199, 203, 211.15, 233; 8/116.1

See application file for complete search history.

(56) References Cited

U.S. PATENT DOCUMENTS

| | | | | |
|---|---|---|---|---|
| 6,042,769 | A * | 3/2000 | Gannon et al. | 264/203 |
| 7,060,211 | B2 * | 6/2006 | Oda | 264/103 |
| 2009/0127750 | A1 | 5/2009 | Bhushan et al. | |
| 2009/0165969 | A1 * | 7/2009 | Luo | 162/76 |

FOREIGN PATENT DOCUMENTS

| | | | |
|---|---|---|---|
| CN | 1383965 | A | 12/2002 |
| CN | 1472374 | A | 2/2004 |
| CN | 1544223 | A | 11/2004 |
| CN | 1760412 | A | 4/2006 |
| CN | 1851115 | A | 10/2006 |
| CN | 101358384 | A | 2/2009 |
| CN | 101429734 | A | 5/2009 |
| CN | 101694019 | A | 4/2010 |
| EP | 2045381 | A1 * | 4/2009 |
| JP | 2005126871 | A | 5/2005 |

OTHER PUBLICATIONS

International Search Report mailed Dec. 16, 2010; International Application No. PCT/CN2010/001359, filed Sep. 7, 2010.

* cited by examiner

*Primary Examiner* — Gregory R Delcotto
*Assistant Examiner* — Preeti Kumar
(74) *Attorney, Agent, or Firm* — Baker and Hostetler LLP

(57) ABSTRACT

A solvent spun bamboo fiber with a high wet modulus and a producing method thereof are disclosed. The producing method includes: activating by adding a bamboo pulp into de-ionized water, adjusting the pH value, adding cellulase and adjusting the pH value by adding alkali; squeezing by vacuum dehydration; pre-dissolving by adding an aqueous solution containing 50-88% by mass of N-methylmorpholine-N-oxide; then dissolving by putting the above pre-dissolved mixture into a dissolver, heating, vacuumizing, dehydrating, dissolving, homogenizing and defoaming; spinning by spraying through a spinneret and forming a bamboo fiber by dry-wet spinning; water washing; bleaching; oiling; and drying. The present method is simple to operate, free of industrial pollution, low energy consuming, and highly safe. The bamboo fiber produced by the present method not only keeps the natural physical and chemical properties of bamboo fiber, but also has a high wet modulus without harmful chemical residues.

2 Claims, No Drawings

SOLVENT SPUN BAMBOO FIBER WITH HIGH WET MODULUS AND PRODUCING METHOD THEREOF

CROSS-REFERENCE TO RELATED APPLICATION

This application claims foreign priority to and is a National Stage Application of International Application No. PCT/CN2010/001359, entitled, "SOLVENT SPUN BAMBOO FIBER WITH HIGH WET MODULUS AND PRODUCING METHOD THEREOF," filed Sep. 7, 2010, which claims priority to Chinese Application No. 200910196861.0, entitled, "SOLVENT SPUN BAMBOO FIBER WITH HIGH WET MODULUS AND PRODUCING METHOD THEREOF," filed Sep. 30, 2009, which are both hereby incorporated by reference in their entirety.

TECHNICAL FIELD

The present invention relates to a bamboo fiber and a method for producing the same, in particular, to a solvent spun bamboo fiber with high wet modulus and a method for producing the same.

BACKGROUND

Bamboo fiber products closely follow the market and take a distinctive route since they needs high technique and has the following unique properties: smooth, soft, cool and comfortable feelings, bacteriostasic and anti-biotic activities, and environmentally friendly, natural and healthcare natures.

Bamboo fiber fabrics can keep its original characters in naturally anti-biotic bacteriostasic and anti-UV activities after washed and sunned repeatedly for many times, which is different from other fabrics in which finishing agents such as antimicrobial and anti-UV agent are added during the post treatment, so it is a real skin-closed healthcare product with a wide application field since it has healthcare activity and sterilization effect for the human skin without causing any allergic untoward effect on the skin.

The application of bamboo fiber fabric in beddings brings the consumers a health, comfortable and cool summer. The bamboo fiber fabric is also praised as a healthy fabric which has the most developing prospect in 21$^{st}$ century.

Viscose process is generally used to produce bamboo fiber. However, this process has problems such as over long producing process, serious environmental pollution, etc., wherein the environmental problem is the most obstacle to develop the regenerated bamboo fiber. Meanwhile, the natural properties of bamboo are destroyed during the processing, for example, the deodorizing, anti-biotic and anti-UV activities of the fiber are greatly decreased. In addition, the various finished fibers produced by viscose process have remained sulfur which will form hydrogen sulfide during high temperature dying, thus resulting in peculiar smell during the processing.

To overcome the above technical problems in viscose process, solvent spun process is used to produce bamboo cellulose fiber.

Chinese invention patent publication CN1190531C disclosed a method for producing a solvent spun bamboo cellulose fiber, which has the following disadvantages: 1. the polymerizing reactor has a volume of 5-300 cubic liter, but in general, the polymerizing reactor with a volume of 5-300 cubic liter is not in the industrial scale; 2. this prior art shows a step of pulp dehydration in which the dehydration need a long time up to 8 hours, which is time-consuming and energy-consuming.

Chinese invention patent application publication CN1760412A disclosed a method for producing a solvent spun regenerated bamboo cellulose fiber, which has the following disadvantages. 1. The producing process is complicated, for example, there are three steps of hydrolysis, acidolysis and enzymolysis during the pretreatment of pulp. The pretreatment needs a long time to perform a hydrolysis of 3-14 hours, an acidolysis of 3-11 hours and an enzymolysis of 2.2-14 hours. In addition, the pretreatment will produce a large amount of industrial waste water because of the hydrolysis and acidolysis. 2. The technical solution will result in a unstable pulp solution since it lacks a process of pre-dissolving.

Chinese invention patent application publication CN1851115A disclosed a method for producing a regenerated bamboo fiber directly from a papermaking bamboo pulp, in which high energy radiation is used to treat the pulp. However, this method suffers a high device cost and large energy consumption, requires high quality producing environment and may result in potential damage to the worker.

SUMMARY OF THE INVENTION

One technical problem of the present invention is to provide a method for producing a solvent spun bamboo fiber with high wet modulus. The said method is easy to operate, free of industrial pollution, low energy consuming and highly safe, and thus suitable to the industrial and continual production of the solvent spun bamboo fiber in large scale.

Another technical problem of the present invention is to provide a solvent spun bamboo fiber with high wet modulus, which is produced by the above said method.

To solve the above technical problems, the present invention is achieved by the following technical solutions.

A method for producing a solvent spun bamboo fiber with high wet modulus, comprising the following steps:

(1) activating a bamboo pulp with a polymerization degree of 400-1000 is added into de-ionized water, and the pH is adjusted to 4-6; cellulase is added therein to perform the activating, and then pH is adjusted to 10-13 by adding an alkali to terminate the activating and yield a pulp paste;

(2) squeezing the above pulp paste is squeezed by vacuum dehydration to yield a cellulose having a water content of 10-60% by mass;

(3) pre-dissolving an aqueous solution containing 50-88% by mass of N-methylmorpholine-N-oxide is added into the above squeezed aqueous cellulose to yield a pre-dissolved pulp;

(4) dissolving the above pre-dissolved pulp is put into a dissolver, heated, vacuumized, dehydrated, dissolved, homogenized, and defoamed to yield a pulp solution;

(5) spinning the above pulp solution is delivered into a flow control pump by a pressure pump and sprayed through a spinneret, then bamboo fiber is spun by dry-wet spinning;

(6) water washing;

(7) bleaching;

(8) oiling;

(9) drying.

Further, in present invention, in the above said step (1), the de-ionized water has a conductivity of less than 5 μs/cm$^2$ a pH value of 6-8, and a temperature of 50° C.;

the cellulase in the above said step (1) is a liquid cellulase;

the outlet temperature in the above said step (3) is at 50-80° C.;

in the above said step (3), the pre-dissolved pulp has a cellulose content of 8-12% by mass and a pH value of 8-12;

in the above said step (3), the mass ratio between the aqueous cellulose and the aqueous solution containing 50-88% by mass of N-methylmorpholine-N-oxide ranges from 1:2 to 1:12;

in the above said step (4), vacuum degree is 1.0 kpa-15.0 kpa and the temperature is at 60-120° C.;

in the above said step (4), the pulp solution has a cellulose content of 11-15% by mass;

in the above said step (5), the spinning velocity is 35-100 m/min, the spinning air space is 5-50 mm, the spinning blowing temperature is 10-25° C., the spinning blowing flow is 100-500 L/H, the blowing relative humidity is 50-80%, the concentration of spinning bath is 10-30% and the spinning bath temperature is at 5-30° C.;

the water washing temperature in the above said step (6) is at 25-60° C.;

in the above said step (7), the bleaching is performed using hydrogen peroxide, wherein the circulating hydrogen peroxide has a concentration of 0.05-1.0% and a pH value of 8-13;

in the above said step (8), the circulating oil has a concentration of 0.5-5%, a pH value of 6-9 and a temperature of 50-70° C.;

the drying temperature in the above said step (9) is at 80-150° C.

In addition, the present invention provides a solvent spun bamboo fiber with high wet modulus produced by the above said method.

Among others, the present invention has the following major advantages:

the present method is easy to operate, free of industrial pollution, low energy consuming, highly safe and suitable for industrial and continuous production of solvent spun bamboo fiber in large scale;

the present method will not destroy the natural properties of the bamboo, so the bamboo fiber produced by the present method can efficiently keep its original functions such as deodorization, anti-bacterium and UV-screening;

the bamboo fiber produced by the present method ensures dress safety because it not only keeps the natural physical and chemical properties of bamboo fiber, but also has no harmful chemical remains;

the bamboo fiber produced by the present method has a high wet modulus of 15 cN/dtex or more, and the finished product made therefrom has a good dimensional stability and is not easy to deform when wet-finishing, washing and laundering, which is suitable for continuous dying, convenient for printing, and advantageous for producing high end fabrics.

DETAILED DESCRIPTION

A method for producing solvent spun bamboo fiber with high wet modulus, comprising the following steps:

(1) activating the activating process is simple and little additive agents are added, and the whole procedure only takes about one hour, and thus the time consumed is short and the process is easy to operate. The specific process is performed as follows:

Preparing process water→adding pulp→adjusting pH value→adding cellulase→terminating the activation, wherein, when preparing process water, de-ionized water was used, parameters: conductivity: <5 μs/cm$^2$, pH: 6-8, temperature: 50° C.;

when adding pulp, a bamboo pulp was added, parameter: polymerization degree: 400-1000;

when adjusting pH, an acid or alkali was used, parameter: pH: 4-6;

when adding cellulase, a liquid cellulase was added, parameters: name: CelluPract® AL70, product number: IPL 5B06610, supplier: BIOPRACT;

when terminating the activation, an alkali was added to adjust the pH value, parameter: pH: 10-13.

(2) squeezing the above pulp paste is squeezed by vacuum dehydration to a required water content, parameters: the aqueous cellulose has a water content of 10-60% by mass and the pulverized aqueous cellulose has a size of 3 cm*3 cm.

(3) pre-dissolving the present invention specially incorporates a step of pre-dissolving which is advantageous not only for stabilizing the quality of the pulp solution, but also for dissolving. The improved pulp solution quality leads to a finished filament with a higher quality. The specific procedures are as follows:

an aqueous solution containing 50-88% by mass of N-methylmorpholine-N-oxide is added into the squeezed aqueous cellulose, wherein the mass ratio of the aqueous cellulose and the aqueous solution containing 50-88% by mass of N-methylmorpholine-N-oxide ranges from 1:2 to 1:12, to swell the pulp, which is more favorite for dissolving uniformly and stabilizing the pulp solution;

parameters: outlet temperature: 50-80° C.; composition of the pre-dissolved pulp: 8-12% by mass of cellulose; pH value: 8-12.

(4) dissolving after passing through the pre-dissolver, the mixture enters into a dissolver, and is then heated, vacuumized, dehydrated, dissolved, homogenized and defoamed to yield an amber transparent uniform pulp solution;

parameters: vacuum degree: 1.0 kpa-15.0 kpa; temperature: 60-120° C.; composition of pulp solution: 11-15% by mass of cellulose.

(5) spinning the pulp solution was delivered into a flow control pump by a pressure pump and sprayed through a spinneret, to spin a fiber by dry-wet spinning;

parameters: spinning velocity: 35-100 m/min; spinning air space: 5-50 mm; spinning blowing temperature: 10-25° C.; spinning blowing flow: 100-500 L/H; blowing relative humidity: 50-80%; concentration of spinning bath: 10-30%; spinning bath temperature: 5-30° C.

(6) water washing the fiber was washed by water to recover the solvent, N-methylmorpholine-N-oxide, so as to increase the recovery of the solvent.

parameter: water washing temperature: 25-60° C.

(7) bleaching the washed fiber was bleached by hydrogen peroxide and stabilizer to reach the required whiteness;

parameters: concentration of circulating hydrogen peroxide: 0.05-1.0%; pH value of circulating hydrogen peroxide: 8-13; temperature of circulating hydrogen peroxide: 75° C.; stabilizer: LAVATEX9188 and DELINOL 9258; manufacturer: Dr. Th. bohme KG, Chem. Fabrik Gmbh & Co.

(8) oiling the bleached fiber was oiled to reach the required oiling rate;

parameters: concentration of circulating oil: 0.5-5%; pH value of circulating oil: 6-9; temperature of circulating oil: 50-70° C.; oil: Lemin OR, Lemin WG and Lemin AN; manufacturer: CLARIANT.

(9) drying.

After oiled, the fiber was heated to reach the required water content;

parameter: drying temperature: 80-150° C.

EXAMPLE 1

Cotton-Like Fiber

A bamboo pulp with a polymerization degree of 500 was added into a process water with a conductivity of less than (<) 5 μs/cm$^2$, a pH value of 6.8 and a temperature of 50° C. Then the pH value thereof was adjusted to 4.5, followed by adding cellulase therein to perform an activation for one hour. After that, sodium hydroxide was added therein to terminate the activation and adjust the pH value to 11. After the termination of the activation, the pulp paste was squeezed by vacuum dehydration to obtain an aqueous cellulose with a water content of 45% by mass, and then the aqueous cellulose was pulverized till its grains had a size of 3 cm*3 cm. An aqueous solution containing 78% by mass of N-methylmorpholine-N-oxide was added therein, wherein the mass ratio of the aqueous cellulose to the aqueous solution of N-methylmorpholine-N-oxide was 1:4, to swell the pulp, the outlet temperature was 70° C., the pre-dissolved pulp comprised 11.5% of cellulose and the pH value thereof was 9.5. After passing through the pre-dissolver, the mixed solution entered into a dissolver, and was controlled at a vacuum degree of 5.0 kpa, and the pulp solution comprised 13.8% of cellulose.

The pulp solution was delivered by a pressure pump, sprayed through a spinneret and spun by dry-wet spinning, wherein the spinning velocity was 50 m/min, the spinning air space was 15 mm, the spinning blowing temperature was 14° C., the spinning blowing flow was 200 L/H, the blowing relative humidity was 50%, the concentration of the spinning bath was 15% and the spinning bath temperature was 8° C. After the fiber was washed by water at a washing temperature of 60° C., the washed fiber was bleached by hydrogen peroxide and stabilizer, in which the concentration of the circulating hydrogen peroxide was 0.20%, the pH value of the circulating hydrogen peroxide was 10.8 and the temperature of the circulating hydrogen peroxide was 75° C. Then the bleached fiber was oiled, in which the concentration of the circulating oil was 1.8%, pH value of the circulating oil was 6.5 and the temperature of the circulating oil was 50° C. After oiled, the fiber was dried at 125° C. to yield a finished fiber which has a denier of 1.58 dtex, a dry breaking strength of 3.5 cN/dtex, a wet breaking strength of 3.0 cN/dtex, a dry breaking elongation of 14.8%, a wet breaking elongation of 17.2%, a wet modulus of 17.9 cN/dtex, a coefficient of dry strength variation of 10%, a whiteness of 58%, an oil content of 0.23% and a moisture regain of 11.2%.

EXAMPLE 2

Medium Length Fiber

A bamboo pulp with a polymerization degree of 550 was added into a process water with a conductivity of less than (<) 5 μs/cm$^2$, a pH value of 6.0 and a temperature of 50° C. Then the pH value thereof was adjusted to 4.2, followed by adding cellulase therein to perform an activation for one hour. After that, sodium hydroxide was added therein to terminate the activation and adjust the pH value to 12. After the termination of the activation, the pulp paste was squeezed by vacuum dehydration to obtain an aqueous cellulose with a water content of 55% by mass, and then the aqueous cellulose was pulverized till its grains had a size of 3 cm*3 cm. An aqueous solution containing 85% by mass of N-methylmorpholine-N-oxide was added therein, wherein the mass ratio of the aqueous cellulose to the aqueous solution of N-methylmorpholine-N-oxide was 1:3, To swell the pulp, the outlet temperature was 68° C., the pre-dissolved pulp comprised 9.5% of cellulose and pH value thereof was 9.0. After passing through the pre-dissolver, the mixed solution entered into a dissolver, and was controlled at a vacuum degree of 7.0 kpa, and the pulp solution comprised 11.2% of cellulose.

The pulp solution was delivered by a pressure pump, sprayed through a spinneret and spun by dry-wet spinning, wherein the spinning velocity was 40 m/min, the spinning air space was 25 mm, the spinning blowing temperature was 16° C., the spinning blowing flow was 350 L/H, the blowing relative humidity was 60%, the concentration of the spinning bath was 15% and the spinning bath temperature was 10° C. After the fiber was washed by water at a washing temperature of 40° C., the washed fiber was bleached by hydrogen peroxide and stabilizer, in which the concentration of the circulating hydrogen peroxide was 0.35%, the pH value of the circulating hydrogen peroxide was 10.5 and the temperature of the circulating hydrogen peroxide was 75° C. Then the bleached fiber was oiled, in which the concentration of the circulating oil was 2.5%, the pH value of the circulating oil was 7.0 and the temperature of the circulating oil was 60° C. After oiled, the fiber was dried at 110° C. to yield a finished fiber which has a denier of 2.18 dtex, a dry breaking strength of 3.33 cN/dtex, a wet breaking strength of 2.98 cN/dtex, a dry breaking elongation of 15.2%, a wet breaking elongation of 17.4%, a wet modulus of 16.8 cN/dtex, a coefficient of dry strength variation of 10%, a whiteness of 55%, an oil content of 0.25% and a moisture regain of 10.5%.

EXAMPLE 3

Wool-Like Fiber

A bamboo pulp with a polymerization degree of 600 was added into a process water with a conductivity of less than (<) 5 μs/cm$^2$, a pH value of 7.3 and a temperature of 50° C. Then the pH value thereof was adjusted to 5.8, followed by adding cellulase therein to perform an activation for one hour. After that, sodium hydroxide was added therein to terminate the activation and adjust the pH value to 12.5. After the termination of the activation, the pulp paste was squeezed by vacuum dehydration to obtain an aqueous cellulose with a water content of 25% by mass, and then the aqueous cellulose was pulverized till its grains had a size of 3 cm*3 cm. An aqueous solution containing 60% by mass of N-methylmorpholine-N-oxide was added therein, wherein the mass ratio of the aqueous cellulose to the aqueous solution of N-methylmorpholine-N-oxide was 1:7, to swell the pulp, the outlet temperature was 75° C., the pre-dissolved pulp comprised 9.1% of cellulose and the pH value thereof was 10. After passing through the pre-dissolver, the mixed solution entered into a dissolver, and was controlled at a vacuum degree of 2.5 kpa, and the pulp solution comprised 12% of cellulose.

The pulp solution was delivered by a pressure pump, sprayed through a spinneret and spun by dry-wet spinning, wherein the spinning velocity was 35 m/min, the spinning air space was 40 mm, the spinning blowing temperature was 20° C., the spinning blowing flow was 500 L/H, the blowing relative humidity was 68%, the concentration of the spinning bath was 23% and the spinning bath temperature was 20° C. After the fiber was washed by water at a washing temperature of 50° C., the washed fiber was bleached by hydrogen peroxide and stabilizer, in which the concentration of the circulating hydrogen peroxide was 0.6%, the pH value of the circulating hydrogen peroxide was 11.5 and the temperature of the circulating hydrogen peroxide was 75° C. Then the bleached fiber was oiled, in which the concentration of the circulating oil was 4.0%, the pH value of the circulating oil was 7.9 and the temperature of the circulating oil was 65° C. After oiled, the fiber was dried at 105° C. to yield a finished fiber which has a denier of 3.21 dtex, a dry breaking strength of 3.28 cN/dtex, a wet breaking strength of 2.85 cN/dtex, a dry breaking elongation of 15.4%, a wet breaking elongation of 17.8%, a wet modulus of 15.2 cN/dtex, a coefficient of dry strength variation of 10%, a whiteness of 50%, an oil content of 0.3% and a moisture regain of 11%.

Each physical index of the bamboo fiber produced in examples 1-3 of the present invention was compared with the data disclosed in CN1190531C and CN1851115A, and the index of the first class product in the Cotton-like Bamboo Viscose Staple Fiber Standard FZ/T52006-2006. The detailed data were shown in table 1.

TABLE 1

| | | denier (dtex) | Dry strength (cN/dtex) | Wet strength (cN/dtex) | Dry breaking elongation % | Wet modulus (cN/dtex) |
|---|---|---|---|---|---|---|
| CN 1190531C | Example 1 | 1.80 | 3.4 | — | 12 | — |
| | Example 2 | 70 dtex/100 F | 3.5 | — | 10 | — |
| CN 1851115A | Example 1 | 1.90 | 3.5 | — | 10 | — |
| | Example 2 | 1.90 | 2.8 | — | 9 | — |
| | Example 3 | 150 dtex/36 F | 3.6 | — | 10 | — |
| | Example 4 | 1.90 | 3.4 | — | 10 | — |
| Present invention | Example 1 | 1.58 | 3.5 | 3.0 | 14.8 | 17.9 |
| | Example 2 | 2.18 | 3.33 | 2.98 | 15.2 | 16.8 |
| | Example 3 | 3.21 | 3.28 | 2.85 | 15.4 | 15.2 |
| the index of the first class product in Cotton Bamboo Viscose Staple Fiber Standard FZ/T 52006-2006, | | ≥1.67 | ≥2.1 | ≥1.1 | ≥17 | — |

It can be seen from examples 1-3 that the bamboo fiber produced in present invention has a high wet modulus of 15 cN/dtex or more.

EXAMPLE 4

Shrinkage Test

Test conditions: (1) the fabric was a woven fabric; (2) at the same atmospheric conditions, the temperature was 20° C. and the relative humidity was 58%; (3) the used shrinker model M988 was used.

The fabrics woven by the bamboo fiber produced in examples 1-3 were compared with that woven by viscose bamboo fiber, and the detailed data were shown in table 2.

TABLE 2

| Property index | | Viscose bamboo fiber fabric | fabric woven by the bamboo fiber in example 1 | fabric woven by the bamboo fiber in example 2 | fabric woven by the bamboo fiber in example 3 |
|---|---|---|---|---|---|
| shrinkage (%) | longitudinal | 6.24 | 1.3 | 1.9 | 1.6 |
| | transverse | 1.26 | 0.4 | 0.2 | 0.3 |

It can be seen from the above data that the fabric using the bamboo fiber produced by the present invention has a much lower shrinkage than that of the viscose bamboo fiber fabric, and thus has a good dimension stability.

EXAMPLE 5

Shrinkage Test of the Yarn in Boiling Water

When testing, the yarn was 32 s.

The yarns spun by the bamboo fiber produced in examples 1-3 were compared with that spun by viscose bamboo fiber and the detailed data are shown in table 3.

TABLE 3

| Property index | viscose bamboo fiber yarn | Yarn spun by the bamboo fiber in example 1 | Yarn spun by the bamboo fiber in example 2 | Yarn spun by the bamboo fiber in example 3 |
|---|---|---|---|---|
| Shrinkage of the yarn in boiling water (%) | 7.0 | 0.56 | 0.49 | 0.53 |

It can be seen from the above data that the shrinkage of the yarn using the bamboo fiber produced in present invention is only about 0.5% which is far lower than that of viscose bamboo fiber.

Undoubtedly, the present invention is not restricted to the examples in the above embodiment and may also include various modifications and variations. In sum, the scope of the present invention may include those modifications or alternatives and variations that are obvious to an ordinary person skilled in the art.

What claimed is:

1. A method for producing a solvent spun bamboo fiber with high wet modulus, the method comprising:

initiating an activation process by adding a bamboo pulp with a polymerization degree of 400-1000 into de-ionized water, adjusting a pH value to 4-6, and adding cellulase i;

terminating the activation process and yielding a pulp paste by adding an alkali and adjusting the pH to a value of 11-13;

squeezing the pulp paste through vacuum dehydration to yield a squeezed aqueous cellulose having a water content of 10-60% by mass;

yielding a pre-dissolved pulp by adding an aqueous solution containing 50-88% by mass of N-methylmorpholine-N-oxide into the squeezed aqueous cellulose, wherein an outlet temperature of the pre-dissolved pulp is at 50-80° C.; the pre-dissolved pulp has a cellulose content of 8-12% by mass and a pH value of 8-12; and the mass ratio between the aqueous cellulose and the aqueous solution containing 50-88% by mass of N-methylmorpholine-N-oxide ranges from 1:2 to 1:12;

yielding a pulp solution by placing the pre-dissolved pulp into a dissolver in which the pre-dissolved pulp is heated, vacuumized, dehydrated, dissolved, homogenized, and defoamed, wherein a vacuum degree during dissolving is 1.0 kpa-15.0 kpa; a temperature during dissolving is at 60-120° C.; and the pulp solution has a cellulose content of 11-15% by mass;

spinning a bamboo fiber by delivering the pulp solution into a flow control pump by a pressure pump, spraying the pulp solution through a spinneret, and then dry-wet spinning the pulp solution in a spinning bath; wherein a spinning velocity is 35-100 m/min, a spinning air space is 5-50 mm, a spinning blowing temperature is 10-25° C., a spinning blowing flow is 100-500 L/H, a blowing relative humidity is 50-80%, a concentration of the spinning bath is 10-30% and a temperature of the spinning bath is at 5-30° C.;

water washing the bamboo fiber;

bleaching the bamboo fiber in a hydrogen peroxide solution having a hydrogen peroxide concentration of 0.05-1.0% and a pH value of 8-13;

oiling the bamboo fiber in a circulating oil solution having an oil concentration of 0.5-5%, a pH value of 6-9, and a temperature of 50-70° C.; and drying the bamboo fiber.

2. The method of claim 1 wherein the solvent spun bamboo fiber has a wet modulus of at least 15 cN/dtex.

* * * * *